US008505241B2

(12) United States Patent
Kusunoki

(10) Patent No.: US 8,505,241 B2
(45) Date of Patent: Aug. 13, 2013

(54) DOOR LEVER FOR CONTROLLING A DOOR OPENING AND CLOSING APPARATUS

(75) Inventor: Kiichi Kusunoki, Atsugi (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 851 days.

(21) Appl. No.: 11/635,142

(22) Filed: Dec. 7, 2006

(65) Prior Publication Data

US 2007/0130837 A1 Jun. 14, 2007

(30) Foreign Application Priority Data

Dec. 8, 2005 (JP) ..... 2005-354593

(51) Int. Cl.
*E05F 11/54* (2006.01)

(52) U.S. Cl.
USPC ..... 49/360; 49/139; 296/146.4

(58) Field of Classification Search
USPC .... 49/139, 140, 503, 360, 13, 14; 292/336.3; 296/146.4, 155
See application file for complete search history.

(56) References Cited

U.S. PATENT DOCUMENTS

| | | | | |
|---|---|---|---|---|
| 5,319,364 | A * | 6/1994 | Waraksa et al. | 340/5.64 |
| 5,836,639 | A * | 11/1998 | Kleefeldt et al. | 296/155 |
| 5,912,631 | A * | 6/1999 | Kusunoki | 340/5.64 |
| 6,049,268 | A * | 4/2000 | Flick | 340/425.5 |
| 6,089,649 | A * | 7/2000 | Hamada et al. | 296/155 |
| 6,091,162 | A * | 7/2000 | Williams, Jr. et al. | 307/10.1 |
| 6,125,583 | A * | 10/2000 | Murray et al. | 49/291 |
| 6,181,024 | B1 * | 1/2001 | Geil et al. | 307/10.2 |
| 6,425,206 | B1 * | 7/2002 | Noda et al. | 49/360 |
| 6,588,829 | B2 * | 7/2003 | Long et al. | 296/155 |
| 6,765,472 | B2 * | 7/2004 | Suparschi et al. | 340/5.62 |
| 6,856,239 | B1 * | 2/2005 | Hicks | 340/5.7 |
| 6,933,831 | B2 * | 8/2005 | Ieda et al. | 340/5.72 |
| 7,052,073 | B2 * | 5/2006 | Ichinose et al. | 296/155 |
| 7,100,325 | B2 * | 9/2006 | Ichinose | 49/168 |
| 7,144,068 | B2 * | 12/2006 | Oxley et al. | 296/155 |
| 7,183,733 | B2 * | 2/2007 | Suzuki et al. | 318/282 |
| 7,187,146 | B2 * | 3/2007 | Saito et al. | 318/285 |
| 7,233,080 | B2 * | 6/2007 | Garnault et al. | 307/10.2 |
| 7,267,391 | B2 * | 9/2007 | Yokomori | 296/155 |
| 7,288,907 | B2 * | 10/2007 | Kamiya et al. | 318/266 |
| 2001/0003405 | A1 * | 6/2001 | Morillon | 307/10.5 |
| 2001/0022049 | A1 * | 9/2001 | Clark et al. | 49/360 |

(Continued)

FOREIGN PATENT DOCUMENTS

| | | | |
|---|---|---|---|
| CN | 1092133 | A | 9/1994 |
| JP | 02-140375 | | 5/1990 |
| JP | 2003-020859 | | 1/2003 |
| WO | WO 2005031092 | A1 * | 7/2005 |

*Primary Examiner* — Gregory J. Strimbu
(74) *Attorney, Agent, or Firm* — Young Basile

(57) ABSTRACT

An opening and closing control apparatus includes an automatic sliding door controller that controls a drive of an opening and closing driving mechanism. The automatic sliding door controller determines whether a request is a manual operating request or an automatic operating request on the basis of a signal from a press switch that is switched on by a press-on operation. In the case of the automatic operating request, the automatic sliding door controller is configured so that an automatic opening and closing determination process determines whether a request is an opening operating request or a closing operating request based on the detection of door state detection section, and an opening and closing process is then executed by operating the opening and closing driving mechanism based on the determination.

18 Claims, 8 Drawing Sheets

(56) References Cited

U.S. PATENT DOCUMENTS

| | | | | |
|---|---|---|---|---|
| 2002/0046439 | A1* | 4/2002 | Agostini et al. | 16/110.1 |
| 2002/0046440 | A1* | 4/2002 | Agostini et al. | 16/110.1 |
| 2003/0216817 | A1* | 11/2003 | Pudney | 700/17 |
| 2004/0074148 | A1* | 4/2004 | Her | 49/324 |
| 2004/0123525 | A1* | 7/2004 | Suzuki et al. | 49/360 |
| 2004/0168371 | A1* | 9/2004 | Engelgau et al. | 49/280 |
| 2004/0257296 | A1* | 12/2004 | Ieda et al. | 343/872 |
| 2005/0176400 | A1* | 8/2005 | Mullet et al. | 455/403 |
| 2006/0055510 | A1* | 3/2006 | Little et al. | 340/5.62 |
| 2006/0107598 | A1* | 5/2006 | Imai et al. | 49/360 |
| 2006/0164029 | A1* | 7/2006 | Suzuki et al. | 318/283 |
| 2006/0168891 | A1* | 8/2006 | Aoyama et al. | 49/360 |
| 2006/0232100 | A1* | 10/2006 | Kamiya et al. | 296/147 |
| 2006/0232378 | A1* | 10/2006 | Ogino et al. | 340/5.62 |
| 2006/0283089 | A1* | 12/2006 | Ishihara et al. | 49/360 |
| 2007/0107313 | A1* | 5/2007 | Suzuki et al. | 49/360 |
| 2007/0120382 | A1* | 5/2007 | Chevalier | 292/336.3 |
| 2007/0164104 | A1* | 7/2007 | Dulgerian et al. | 235/382 |
| 2007/0188120 | A1* | 8/2007 | Mullet et al. | 318/280 |

* cited by examiner

DOOR LEVER FOR CONTROLLING A DOOR OPENING AND CLOSING APPARATUS

CROSS-REFERENCES TO RELATED APPLICATIONS

This application claims priority from Japanese Patent Application Serial No. 2005-354593, filed on Dec. 8, 2005, which is incorporated herein in its entirety by reference.

TECHNICAL FIELD

The present invention relates to a door lever, to an opening and closing control apparatus capable of automatically opening and closing a door provided on a vehicle and to a method for opening and closing the door.

BACKGROUND

An opening and closing control apparatus that automatically opens and closes a sliding door provided on a side of vehicle body has been disclosed in Japanese Patent Provisional Publication No. 2003-020859. In this reference, the opening and closing control apparatus includes a sliding door slidable along a side portion of the vehicle body, an opening and closing driving mechanism equipped with a cable, etc., to transfer driving force from a motor to the sliding door and a control system that controls an operation of the opening and closing driving mechanism. Thereby, the sliding door is automatically opened and closed.

An outside handle and an inside handle are provided on the sliding door, each of which manually releases a latch that holds the sliding door at its fully closed position. Each of the outside and inside handles is provided with an opening switch that is switched on at the handle operation to open the sliding door and a closing switch that is switched on at the handle operation to close the sliding door.

The control system is connected to the opening and closing switches. The control system is also connected to a manual operation selection switch that switches between manual open/close mode and automatic open/close mode, a switch for opening, and a switch for closure, all set by the driver's seat.

When the manual operation selection switch is set to the automatic open/close mode, the control system automatically slides and opens/closes the sliding door by the opening and closing driving mechanism. When the opening switch provided at both of the outside and inside handles, or the switch for opening provided at the driver's seat, is switched on the opening and closing driving mechanism operates in a direction that opens the sliding door, and the sliding door automatically slides to its fully open position. When the closing switch provided at both of the outside and inside handles, or the switch for closure provided at the driver's seat, is switched on the opening and closing driving mechanism operates in a direction that closes the sliding door, and the sliding door automatically slides to its fully closed position.

BRIEF SUMMARY OF THE INVENTION

According to one example of an opening and closing control apparatus for a door taught herein, the apparatus comprises a door lever positioned on the door for manually opening or closing the door, an operation output unit positioned at the door lever, the operation output unit outputting an operating signal responsive to a predetermined operation of the door lever different from an opening or closing operation on the door lever for manually opening or closing the door and a driving unit operable to open or close the door based on the operating signal.

Another opening and closing control apparatus for a door taught herein includes manual means, disposed at the door, for manually opening or closing the door, operation outputting means positioned at the manual means for outputting an operating signal responsive to a predetermined operation of the manual means different from an opening or closing operation of the manual means for manually opening or closing the door and driving means for opening or closing the door based on the operating signal.

A door lever for a door of a vehicle body is also taught herein. One such door lever comprises a pivotable attachment attaching the door lever to the door located at a first end of the door lever, wherein a pivoting operation of the door handle indicates at least one of a manual opening and closing operation of the door, and a signaling device for signaling at least one of an automatic opening and an automatic closing of the door by a different operation from the pivoting operation, the signaling device positioned proximate to the pivotable attachment or at an opposed end of the door lever.

In yet another example of the teachings herein, a method for opening and closing a door of a vehicle body can comprise detecting an operation condition of a door lever for unlatching the door and determining whether the operation condition is a request for manual operation or for automatic operation.

BRIEF DESCRIPTION OF THE DRAWINGS

The description herein makes reference to the accompanying drawings wherein like reference numerals refer to like parts throughout the several views, and wherein:

FIGS. 4A, 4B and 4C are sectional views showing the outside handle of the opening and closing control apparatus according to the first example, wherein FIG. 4A illustrates a state of a press-on operation, FIG. 4B illustrates a neutral state, and FIG. 4C illustrates a state of a pull operation;

FIGS. 9A and 9B are sectional views showing an outside handle of the opening and closing control apparatus according to a second example, wherein FIG. 9A illustrates a state of a press-on operation and FIG. 9B illustrates a state where a press-on operation is not performed;

FIGS. 11A and 11B are front views showing other examples, wherein FIG. 11A illustrates one operation of the opening and closing operations by the manual operation, and FIG. 11B illustrates another operation of the opening and closing operations.

DETAILED DESCRIPTION OF EMBODIMENTS OF THE INVENTION

Figure 1:
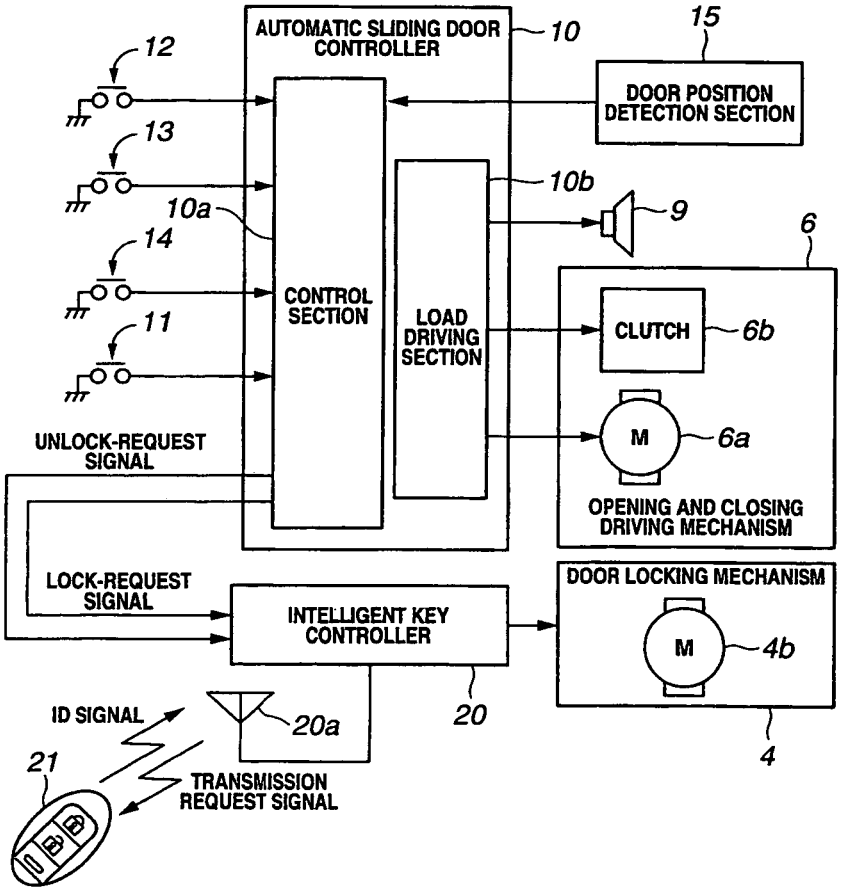
FIG. 1 is a block diagram showing a configuration of an opening and closing control apparatus according to a first example.

In Japanese Patent Provisional Publication No. 2003-020859 described above, when the manual operation selection switch is set to the manual open/close mode, an operation of the opening and closing driving mechanism is not made. Thus, even if the switch for opening or the switch for closure is switched on, the opening and closing driving mechanism does not operate. The sliding door can then be manually slid by operation of the outside handle or the inside handle.

In contrast, disclosed herein is a system that provides an opening and closing control apparatus, an opening and closing determination method and a door lever operable to provide the convenience of requesting the automatic opening and closing operation and the manual opening and closing operation.

More particularly, and referring to FIGS. 1-8, an opening and closing control apparatus according to the first example includes a door 2 provided for a vehicle body 1 and a door lever 5 provided or disposed at the door 2 for manually performing an opening and closing operation. The apparatus also includes an opening and closing driving mechanism 6 capable of an automatic opening and closing operation in which the door 2 is opened and closed by providing a driving force of a driving unit 6*a* to the door 2, a door state (or position) detection section 15 that detects an open/close state of door 2 and a controller 10 that controls operations of the opening and closing driving mechanism 6.

The opening and closing control apparatus further includes an operation outputting unit 11 provided at the door lever 5 or proximate to the door lever 5 and outputs an operating signal by a predetermined operation that is different from the manual opening and closing operation of door lever 5. The controller 10 determines whether a request is a manual operating request or an automatic operating request on the basis of the signal from operation outputting unit 11. Further, in the case of the automatic operating request, an automatic opening and closing determination process is made in which the controller 10 determines whether a request is an opening request or a closing request based on the detection of the door state detection section 15. An opening and closing process is made in which controller 10 operates the opening and closing driving mechanism 6 based on the determination result.

Figure 2:
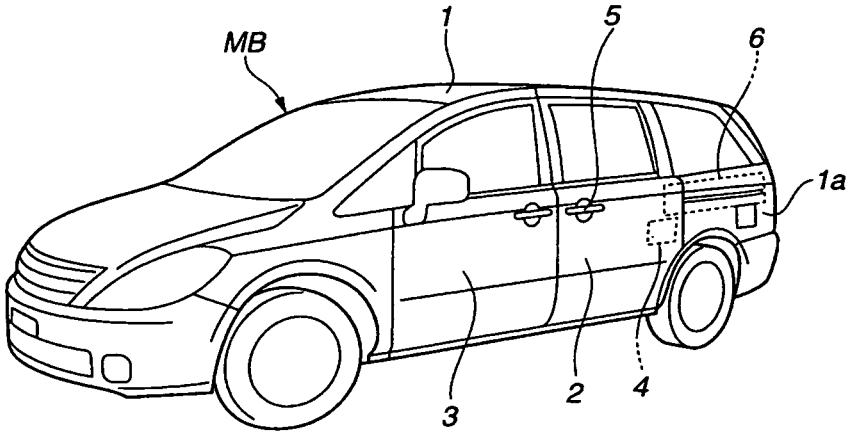
FIG. 2 is a perspective view showing a vehicle including the opening and closing control apparatus according to the first example.

As mentioned, the opening and closing control apparatus according to the first example is an apparatus that slides a sliding door 2 provided on the side of a vehicle body 1 of a vehicle MB as shown in FIG. 2, and then opens and closes a door opening or a door opening section. As shown in FIG. 2, the side sliding door 2 is placed at a rear of the vehicle MB behind a front side door 3 and is supported slidably in the front and rear directions of the vehicle by a slide guide rail.

A fore and aft opening and closing sliding movement of sliding door 2 is available in two ways, including manual and automatic operations. That is, an outside handle 5 is provided on an outer side of the sliding door 2, and the door lever is capable of manually releasing a latch of a locking mechanism 4 that holds the sliding door 2 at its fully closed position. By grasping the outside handle 5 and exerting an operating physical force, it is possible to manually open and close the sliding door 2 (see FIGS. 4A-C).

Meanwhile, the automatic operation of sliding door 2 is provided by means 1*a* of vehicle body 1. The opening and closing driving mechanism 6 has a drive transfer member (not shown) such as an endless loop cable or chain linked to the sliding door 2. A sliding door motor 6*a* (see FIG. 1) is the driving unit that provides the driving force to the drive transfer member.

A clutch 6*b* (see FIG. 1) is also provided between the sliding door motor 6*a* and the drive transfer member. The opening and closing driving mechanism 6 is configured so that switching between a state where the sliding door motor 6*a* is connected to the sliding door 2 and a state where this connection is released is possible through engagement and release of the clutch 6*b*. Since this type of opening and closing driving mechanism 6 is well known, its detailed explanation is omitted.

Figure 4A:
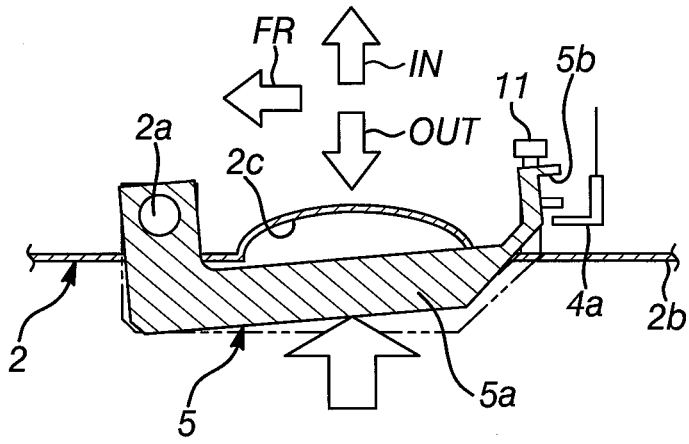
Figure 4B:
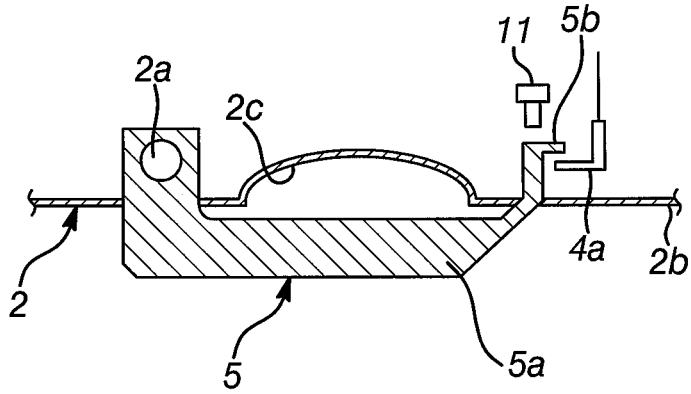
Figure 4C:
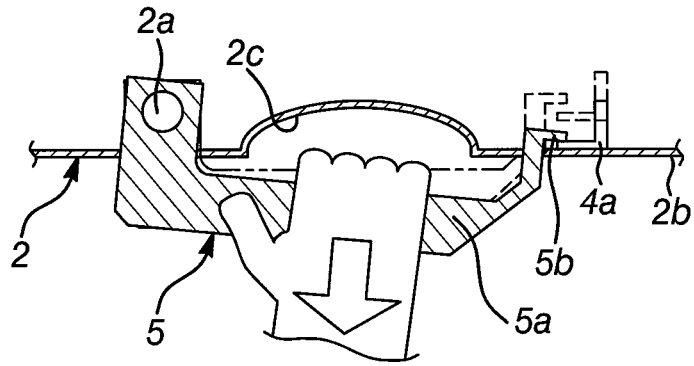

With respect to the outside handle 5, as shown in FIGS. 4A-C, the front end portion (an arrow "FR" indicates a front direction of the vehicle) of the outside handle 5 is supported pivotally in a direction of the vehicle width about a rotation axis 2*a* provided at the sliding door 2. In the middle of the outside handle 5, a grip portion 5*a* for a user to grasp is formed. A rear end portion of the outside handle 5 is positioned at an inner side of a door outer panel 2*b* of sliding door 2, and an operation transmission piece 5*b* is formed at an outermost end of the rear end portion.

Figure 3:
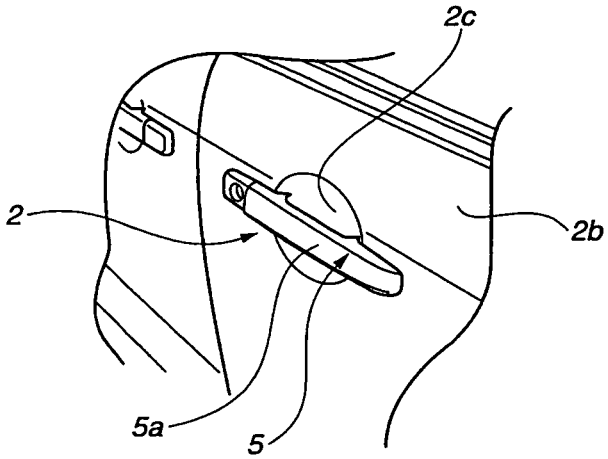
FIG. 3 is a perspective view showing an outside handle of the opening and closing control apparatus according to the first example.

The door outer panel 2*b* includes a recessed portion 2*c* that is formed into a substantially round shape and is recessed in an inward direction of the vehicle (in a direction indicated by an arrow "IN" in FIG. 4A). The recessed portion 2*c* is at a position facing the grip portion 5*a* of the outside handle 5 as also seen in FIG. 3.

A normal position of the outside handle 5 is set to a neutral position, which is the middle position of the pivotable range as shown in FIG. 4B, by a biasing means such as a spring (not shown). Further, the outside handle 5 is set so that a pull operation from the neutral position to an outward direction of the vehicle (in a direction indicated by an arrow "OUT") as shown in FIG. 4C, and a press-on operation from the neutral position to the inward direction of the vehicle (in the direction indicated by the arrow "IN") as shown in FIG. 4A, are available.

An input lever 4*a* of the locking mechanism 4 (see FIG. 1) is positioned for engagement with the operation transmission piece 5*b* between the operation transmission piece 5*b* and the door outer panel 2*b*. As shown in FIG. 4C, the input lever 4*a* is set so that the operation transmission piece 5*b* pulls the input lever 4*a*. Thereby, the holding of the door held by the latch of the locking mechanism 4 is released when the pull operation of outside handle 5 in the outward direction of the vehicle is made.

The operation outputting unit is shown as press switch 11 provided at a position facing the operation transmission piece 5*b* inside the door outer panel 2*b*. That is, as shown in FIG. 4A, the press switch 11 is set so that the operation transmission piece 5*b* can push, or press, on the press switch 11 when the press-on operation of the outside handle 5 in the inward direction of the vehicle is made. By this operation of switching-on, the press switch 11 changes from OFF to ON and outputs the operating signal.

Figure 5:
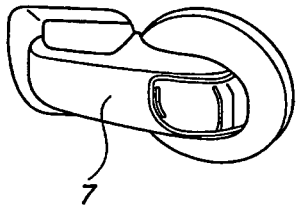
FIG. 5 is a perspective view showing an inside handle of the opening and closing control apparatus according to the first example.

An inside handle 7 is provided on an inner side of the sliding door 2 in the interior of the vehicle as shown in FIG. 5. In the same manner as the outside handle 5, the inside handle 7 can release the holding of the door held by the latch of the locking mechanism 4. Further, the inside handle 7 is also provided with a press switch 11, similar to the outside handle 5, that is capable of executing the opening and closing control. The outside handle 5 acts as the door lever and it will be explained in more detail hereinafter.

The locking mechanism 4 has a door lock motor 4*b* as a driving unit (or driving means) as shown in FIG. 1. The locking mechanism 4 is operably configured to lock and unlock the sliding door 2 by way of the drive of the door lock motor 4*b*. The capability of the locking mechanism 4 to lock and unlock the sliding door manually or by the drive of the door lock motor 4*b* is well known. Therefore, its detailed explanation is omitted.

The door lock motor 4*b* of the locking mechanism 4, the sliding door motor 6*a* of the opening and closing driving mechanism 6 and the press switch 11, among other elements to be discussed, are connected to the automatic sliding door controller 10. The automatic sliding door controller 10 includes a control section 10*a* having a central processing unit (CPU) that runs the programming as discussed herein and memory (a ROM or RAM or both) used for storing programs and operation results. The processing parts (e.g., programming instructions) described hereinafter are generally stored in memory, and the functions of each of the parts is performed by the logic of the CPU. The controller 10 can be a dedicated microcontroller, but the functions performed by this controller could also be performed by a standard engine microcontroller that includes a CPU, random access memory, read only memory and input/output ports receiving input signals and sending the output signals as discussed in more detail below, or could be a microprocessor using external memory. The load driving section 10*b* of the controller 10 drives the opening and closing driving mechanism 6. A speaker 9 performs the function of informing the driver of a status of the door 2.

More specifically, the control section 10*a* receives input signals from the press switch 11, a main switch 12, a driver's seat opening and closing operation switch 13, a door lock state detection switch 14 and the door position detection device 15.

Figure 6:
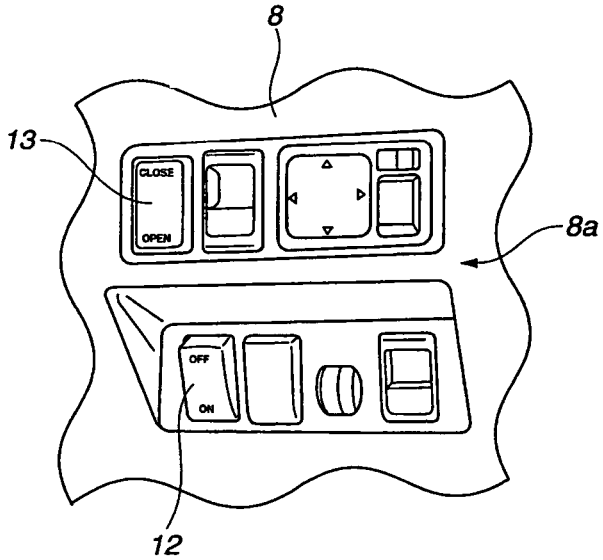
FIG. 6 is a perspective view showing a switch unit set on an inner side surface of a front side door of the vehicle having the opening and closing control apparatus according to the first example.

The main switch 12 and the driver's seat opening and closing operation switch 13 are disposed on a switch unit 8*a* that is set on an inner surface of a front side door 8 beside the driver's seat as seen in FIG. 6. The new main switch 12 is a switch that selects either a mode capable of the automatic opening and closing operation of sliding door 2 or a mode for the manual opening and closing of sliding door 2. When the main switch 12 selects the manual opening and closing operation then the system is totally incapable of the automatic opening and closing operation. The driver's seat opening and closing operation switch 13 is a switch that selectively executes the automatic opening and closing operation, which automatically opens or closes the sliding door 2 from the driver's seat.

The door position detection device 15 is a device capable of detecting three states of the door including a fully open state, a fully closed state and a middle state between the fully open and closed states. The door position detection device 15 can be formed by a switch that detects the positions of only the fully open and closed states. Or, the door position detection device can also detect every position between the fully open and closed positions by a signal from a member of the opening and closing driving mechanism 6, which rotates in synchronization with the slide of sliding door 2.

The automatic sliding door controller 10 is configured to output an unlock-request signal and a lock-request signal to an intelligent key controller 20, also called a lock controller.

The intelligent key controller 20 operates the locking mechanism 4 and automatically changes the locking and unlocking of the locking mechanism 4 on the basis of an exchange of signals between the intelligent key controller 20 and a portable instrument (or intelligent key) 21, which a vehicle's occupant carries. That is, when the unlock-request signal or the lock-request signal is output from the automatic sliding door controller 10, the intelligent key controller 20 outputs a transmission request signal from an antenna 20*a* to a portable instrument 21. When the portable instrument 21 receives the transmission request signal, the portable instrument 21 outputs a preprogrammed ID signal. If the programmed ID signal received through the antenna 20*a* matches a previously stored ID signal, the intelligent key controller 20 operates the locking mechanism 4 and changes the locking and unlocking status.

One method of control by the automatic sliding door controller 10 is now explained. In a first example, when the main switch 12 is switched on, the opening and closing control is made according to the operations of driver's seat opening and closing operation switch 13 and press switch 11 provided for the outside handle 5. The door sliding control of sliding door 2 of driver's seat opening and closing operation switch 13 is a control already known, and therefore its explanation is omitted. The control according to the operation of press switch 11 will now be explained.

The steps of the opening and closing control by the sliding door controller 10 will be explained hereinafter by using the flow charts in FIGS. 7 and 8.

At step S1 a query is made to determine whether or not press switch 11 changes from "OFF" to "ON", that is, whether or not press switch 11 changes to an on-state by being pushed on by way of the press-on operation of outside handle 5. If press switch 11 changes to "ON", the routine proceeds to the next step S2. If press switch 11 remains unchanged, step S1 is repeated until the status of press switch 11 changes.

At step S2 a query is made to determine, based on the detection of door position detection device 15, whether or not the sliding door 2 is in an automatic opening operation. If sliding door 2 is in the automatic opening operation, the routine proceeds to step S5. If the sliding door 2 is not in the automatic opening operation, the routine proceeds to step S3.

At step S3 a query is made to determine whether or not a current position of sliding door 2 is a middle position or some position between the fully open and closed positions. If the current position is the middle position, the routine proceeds to step S14 (in FIG. 8). If the current position is not the middle position, the routine proceeds to step S4.

At step S4 a query is made to determine whether or not the current position of sliding door 2 is the fully closed position. If the current position is the fully closed position, the routine proceeds to step S18 (in FIG. 8). If the current position is not the fully closed position, namely the current position is the fully open position, the routine proceeds to step S5.

At step S5 a query is made to determine whether or not a switched-ON period of the press switch 11 is longer than or equal to a specified time period. If the switched-ON period is longer than or equal to the specified time period, the routine proceeds to step S6. If the switched-ON period is shorter than the specified time period, the routine proceeds to step S22.

At step S6 a process is executed in which the lock-request signal that requests the locking operation is output to the intelligent key controller 20. Additionally, a counting of a lock-wait-timer is started.

At the following step S7, a check is made to determine, based on the status the door lock state detection switch 14, whether or not the sliding door 2 is in a locked state. If the sliding door 2 is in the locked state (or conversely the locking mechanism 4 is in a locking state), the routine proceeds to step S9 (in FIG. 8). If the sliding door 2 is an unlocked state (or conversely, the locking mechanism 4 is in an unlocking state), the routine proceeds to step S8.

At step S8 a query is made to determine whether or not the lock-wait-timer continues to count up. If the lock-wait-timer is finished counting, the routine returns to step S1. If the lock-wait-timer is still counting, the routine returns to step S7.

On the other hand, if the sliding door 2 is in a locked state in response to the query of step S7, at step S9 (in FIG. 8) the automatic closing operation is initiated. That is, in the automatic closing operation the engagement of the clutch 6*b* is made, and the sliding door motor 6*a* is driven and rotates in a direction closing the sliding door 2 in the opening and closing driving mechanism 6.

At the following step S10, a warning or informing notice is issued through speaker 9 that the sliding door 2 is going into the locked state after the automatic closing operation that slides and closes the sliding door 2. This warning is made or announced by either one or both of voices and beep tones.

At the following step S11, a query is made to determine whether or not the press switch 11 changes from "OFF" to "ON." That is, whether or not the press-on operation of outside handle 5 is made. If the press switch 11 is switched on, the routine returns to step S1. If the press switch 11 is not switched on, the routine proceeds to step S12.

At step S12 a query is made to determine whether or not the sliding door 2 reaches the fully closed position. If the sliding door 2 does not reach the fully closed position, the routine returns to step S10. If the sliding door 2 reaches the fully closed position the routine proceeds to step S13, and the automatic closing operation is terminated. In the termination of the automatic closing operation the drive of sliding door motor 6*a* is stopped, and clutch 6*b* is released.

Figure 8:
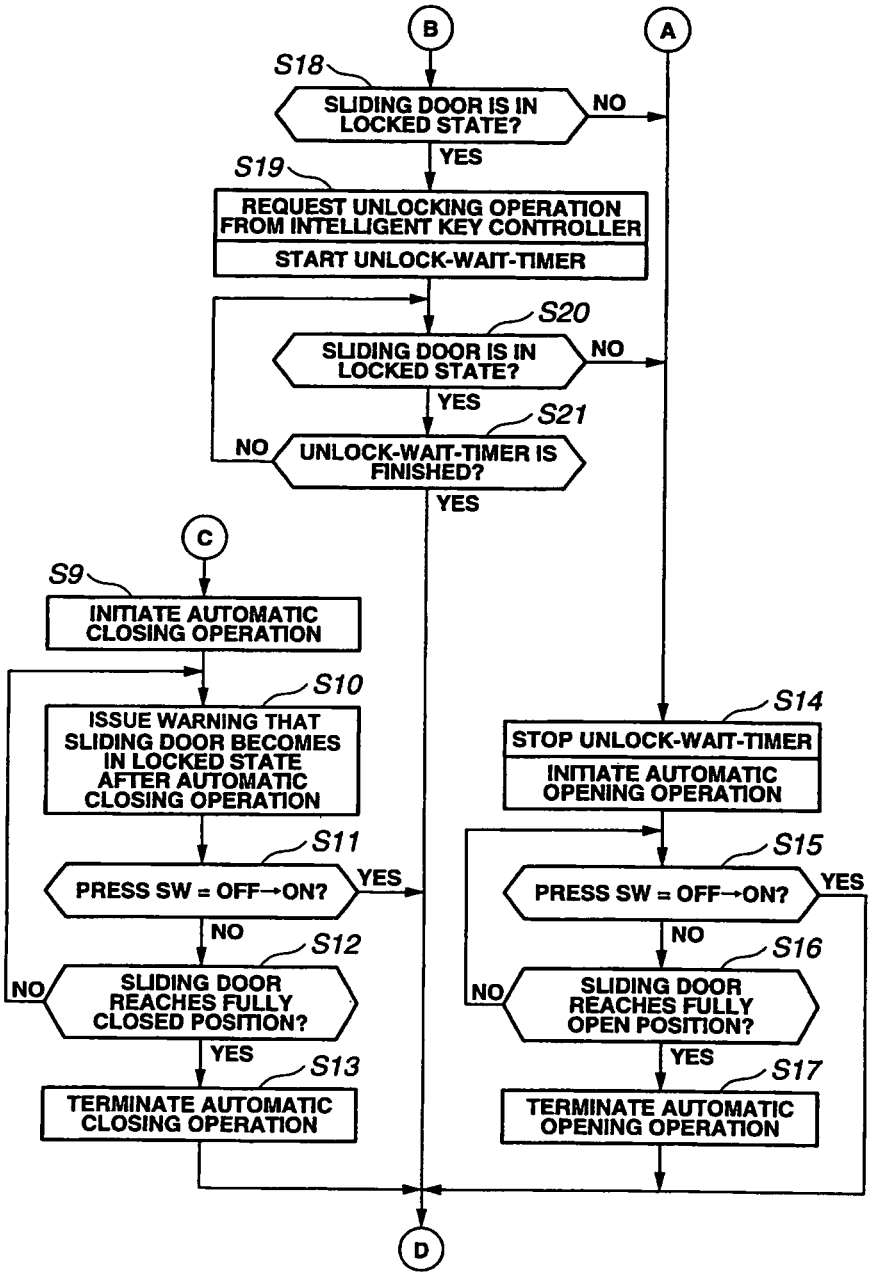
FIG. 8 is a flow chart showing the continuing steps of the opening and closing control apparatus according to the first example.

Returning to step S3, as mentioned above if the response to the query is "YES", the routine proceeds to step S14 (FIG. 8). At step S14 the unlock-wait-timer is stopped; and the automatic opening operation is initiated. That is, in the opening and closing driving mechanism 6 the engagement of clutch 6*b* is made, and the sliding door motor 6*a* is driven and rotates in a direction opening the sliding door 2.

At the following step S15, a check is made to determine whether or not the press switch 11 changes from "OFF" to "ON". If press switch 11 changes to "ON", the routine returns to step S1. If the press switch 11 remains unchanged, the routine proceeds to step S16. At step S16, a check is made to determine whether or not the sliding door 2 reaches the fully open position. This routine repeats steps S15 and S16 until sliding door 2 reaches the fully open position.

When the sliding door 2 reaches the fully open position at step S16 the routine proceeds to step S17, where the automatic opening operation is terminated.

Returning to step S4, as mentioned above if the current position of sliding door 2 is in the fully closed position, the routine proceeds to step S18 (FIG. 8). At step S18 a check is made to determine whether or not the sliding door 2 is in the locked state. If the sliding door 2 is in the unlocked state, the routine proceeds to step S14. On the other hand, if the sliding door 2 is in the locked state, the routine proceeds to step S19.

At step S19 the unlock-request signal that requests the unlocking operation is output to the intelligent key controller 20. Additionally, counting using the unlock-wait-timer is started.

At the following step S20, a query is again made to determine whether or not the sliding door 2 is in the locked state. If the sliding door 2 is in the unlocked state the routine proceeds to step S14, which has been discussed previously. If the sliding door 2 is in the locked state the routine proceeds to step S21.

At step S21 a query is made to determine whether or not the count of the unlock-wait-timer is finished. If the count of the unlock-wait-timer is not finished the routine returns to step S20. If the unlock-wait-timer is finished at step S21, the routine returns to step S1.

Returning to step S5, when the switched-ON period of the press switch 11 is shorter than the specified time period, processing advances to step S22. At step S22 the automatic closing operation is initiated. At following step S23, a query is made to determine whether or not press switch 11 changes from "OFF" to "ON". If press switch 11 changes to "ON", the routine returns to step S1. If press switch 11 remains unchanged, the routine proceeds to step S24.

At step S24 a query is made to determine whether or not the sliding door 2 reaches the fully closed position. If the sliding door 2 does not reach the fully closed position the routine returns to step S23. If the sliding door 2 reaches the fully closed position the routine proceeds to step S25, where the automatic closing operation is terminated.

Next, an operation of the opening and closing control apparatus is explained. The following is an explanation of a mode capable of automatic opening and closing operation under a condition when the main switch 12 is "ON."

In a case where the user manually opens or closes the sliding door 2, the user pulls the outside handle 5 provided on the outer side of sliding door 2 and releases the latch of the locking mechanism 4, which holds the sliding door 2. The user then opens or closes the sliding door 2.

As shown in FIG. 4C, when the user pulls the outside handle 5, the operation transmission piece 5*b* of the outside handle 5 engages with the input lever 4*a* and mechanically releases the latch of the locking mechanism 4. Thereby the sliding door 2 is slid through an application of the operating physical force to outside handle 5.

However, when pulling outside handle 5, press switch 11, which is capable of working with outside handle 5, can not be pressed on. The automatic sliding door controller 10 never executes the operation.

Thus, even in a case where the main switch 12 remains "ON" when the user pulls the outside handle 5 to manually slide and open and close the sliding door 2, the automatic sliding door controller 10 judges that the user intends to manually open or close sliding door 2, and does not execute the automatic operation.

For example, in a case of bad weather, or in a case where the user wants to partially open or close the sliding door 2 instead of fully opening sliding door 2, or in a case where the user wants to open or close sliding door 2 quickly, it is possible to manually open and close the sliding door 2 without a mode change operation, namely without changing the main switch 12.

Next, the automatic operation by the opening and closing driving mechanism 6, executed when the user wants to receive the convenience by the automatic operation, is explained.

When the user wants to execute the automatic operation, as shown in FIG. 4A, the user performs a pressing operation of the outside handle 5 in the inward direction of the vehicle.

When the press switch 11 is pressed on by the press-on operation of the outside handle 5, the automatic sliding door controller 10 determines that the user has requested the automatic operation. Further, at the time it is determined that this request for the automatic operation has been made, the automatic sliding door controller 10 performs the automatic opening and closing determination process that judges, based on the detection of door position detection device 15, etc., whether the execution is for an opening operation or closing operation. After that, the opening and closing process is executed in which the automatic sliding door controller 10 operates the opening and closing driving mechanism 6.

More specifically, in the example shown, at step S1 when the press switch 11 is pressed on (i.e., changes from "OFF" to "ON"), the automatic sliding door controller 10 determines that the user requests the automatic operation and then executes the subsequent processes after step S2.

On the basis of the responses to the queries of steps S2 to S5, the automatic opening and closing determination process is executed. In this automatic operation, the automatic sliding door controller 10 determines whether the user requests the automatic opening operation or the automatic closing operation.

In the automatic opening and closing determination process of the first example, when the sliding door 2 is fully closed or is halfway open by a hand operation, the automatic sliding door controller 10 determines that the request is a request for the automatic opening operation.

When the sliding door 2 is fully open or the sliding door 2 is in sliding motion for the automatic opening, the automatic sliding door controller 10 determines that the request is a request for the automatic closing operation.

Next, the automatic opening and closing operations are explained.

As mentioned above, in the first example the automatic opening operation is the operation that is executed when the sliding door 2 is fully closed or the sliding door 2 is in the half-opened state (that is, the sliding door 2 is at the middle position between the fully open and closed positions). These operations will be explained respectively.

First, an explanation will be made of when the automatic opening operation is executed when the sliding door 2 is halfway open by manual operation.

Figure 7:
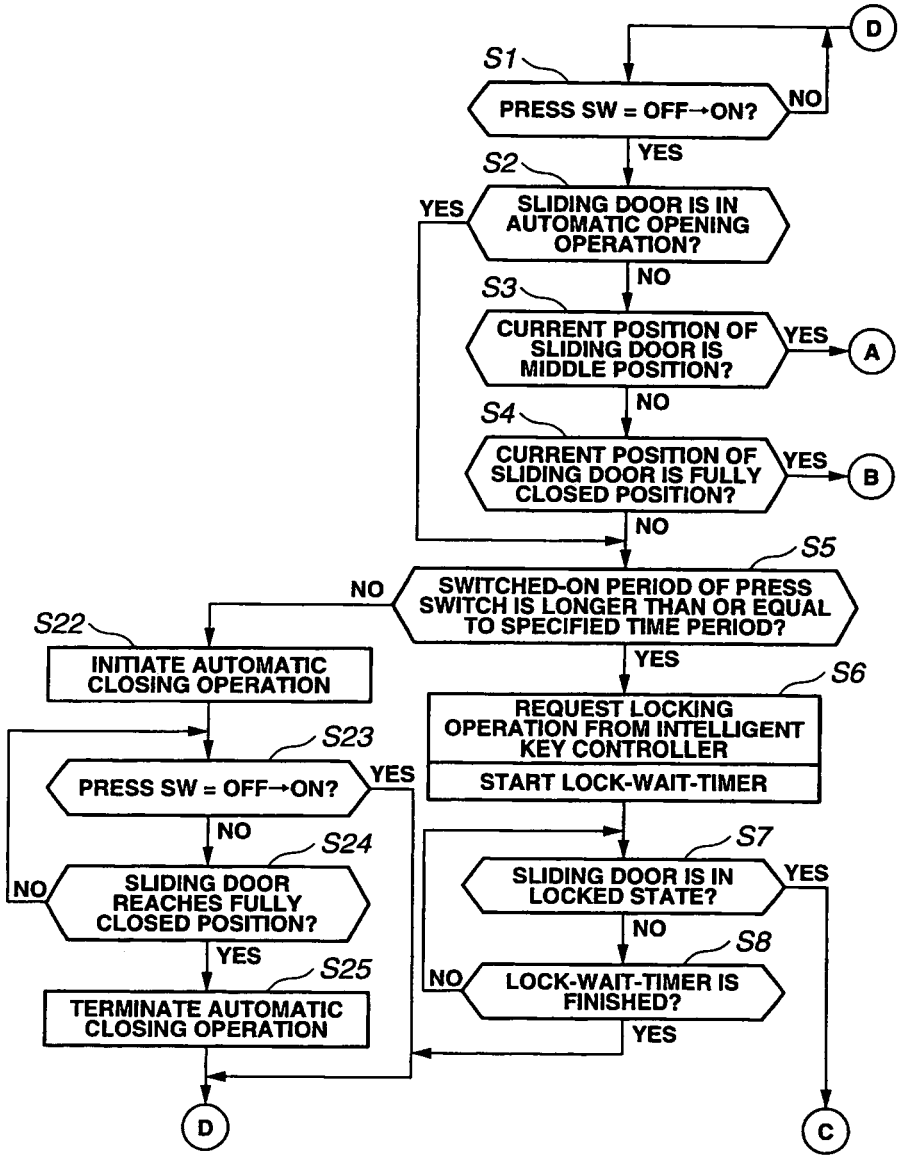
FIG. 7 is a flow chart showing the steps of the control of the opening and closing control apparatus according to the first example.

In a case where the press switch 11 is pressed under the condition where the sliding door 2 is halfway open by a manual operation, in the flow charts in FIGS. 7 and 8 the routine proceeds according to steps S1→S2→S3→S14, and the automatic opening operation is initiated by the process at step S14. That is, the engagement of the clutch 6*b* is made, and the sliding door motor 6*a* is driven and rotates in the direction opening the sliding door 2. The sliding door 2 is therefore slid and opens.

If the press switch 11 is not pressed while the automatic opening operation is being executed, namely, if the user does not perform the press-on operation of the outside handle 5 while this automatic opening operation is in progress, the automatic opening operation is executed on the basis of steps S15, S16 and S17 until sliding door 2 reaches the fully open position. When terminating the automatic opening operation after the sliding door 2 reaches the fully open position the drive of the sliding door motor 6*a* is stopped, and the clutch 6*b* is released. In a state where the sliding door 2 reaches the fully open position the latch holds the sliding door 2, and then movement of the sliding door 2 in the direction to close the sliding door 2 is restrained or controlled. The automatic opening operation is terminated, and the routine returns to a standby state that repeats step S1.

On the other hand, if the press-on operation of the outside handle 5 is done during the progress of the automatic opening operation, the automatic sliding door controller 10 determines that the answer is "YES" at step S15 and step S1. Then, the automatic sliding door switches over to the automatic closing operation. The details of its operation are described hereinafter. With respect to the determinations at steps S15 and S1, the steps are made at or near the same time, i.e., substantially simultaneously, and thus the automatic sliding door controller 10 determines that the answer is "YES" at both the steps S15 and S1 by one operation of the pressing on of press switch 11.

As explained above, when the press switch 11 is pressed on by the press-on operation of the outside handle 5 under the condition where the sliding door 2 is halfway open by a hand operation, the automatic opening operation is executed. The sliding door 2 slides to the fully open position.

A case where the automatic opening operation is executed from the state where sliding door 2 is fully closed and locked by the locking mechanism 4 (or conversely, locking mechanism 4 is in the locking state) is now explained.

In this case, as in the automatic opening operation from a half-opened position, the user performs the press-on operation of the outside handle 5. Thereby the press switch 11 is pressed on.

When the press switch 11 is pressed on, and when the sliding door 2 is fully closed and is in the door-locked state, the routine proceeds according to steps S1→S2→S3→S4 in the flow charts in FIGS. 7 and 8. Further, on the basis of the determination at step S4, the routine proceeds to steps S18 and S19. In the process at step S19, the unlock-request signal requesting an unlocking operation is output to the intelligent key controller 20. Additionally, the counting of the unlock-wait-timer is started at the same time.

The intelligent key controller 20, having received the unlock-request, outputs radio waves containing the transmission request signal. Meanwhile, if a portable instrument 21 exists in a communication area, the portable instrument 21 returns the radio waves containing the ID signal.

The intelligent key controller 20 checks the received ID signal against the previously stored ID signal. If the received and stored ID signals match, the door lock motor 4*b* is driven and rotates in a direction that releases the lock.

With respect to the unlock-wait-timer, a timer counts a time required for a release of the lock of a locking mechanism 4 according to the control of the intelligent key controller 20.

When the lock of locking mechanism 4 is released, the routine proceeds from step S20 to step S14. Then, the unlock-wait-timer is stopped, and the automatic opening operation is initiated. Further, on the basis of the processes at steps S14 to S17, the sliding door 2 is slid to the fully open position. The automatic opening operation is terminated, and the routine returns to a standby state that repeats step S1.

If the lock of the locking mechanism 4 is not released despite the fact that the counting of the unlock-wait-timer is completed, the routine returns to step S1 based on the processes at steps S20 and S21. In such cases, the automatic sliding door controller 10 determines that the press-on operation of the outside handle 5 is not the operation performed by the user carrying the portable instrument 21 capable of the unlocking operation, and consequently does not execute the automatic opening operation. In other words, if the sliding door controller 10 cannot identify the existence of the previously registered portable instrument 21 within a predetermined time period and also within the communication area, the release of the lock and the automatic opening operation are forbidden.

As explained above, under conditions where the sliding door 2 is fully closed, the locking mechanism 4 is in the locking state, and portable instrument 21 exists in the communication area, when the user performs the press-on operation of outside handle 5, the automatic opening operation is executed. The sliding door 2 is slid to the fully open position.

Next, the execution of the automatic closing operation is explained. As mentioned above, in the first example the automatic closing operation is executed in the cases where the sliding door 2 is fully open or the sliding door 2 is in the sliding motion of the automatic opening (that is, during the automatic opening operation).

In the first example, the sliding door controller 10 is configured to determine whether the request is a request for the automatic closing operation or a request for the lock of the locking mechanism 4 along with the automatic closing operation according to a switch-on time period of the press switch 11. The determination of the automatic operation, in sum, is based on a length of pressing-on time of the outside handle 5. In the first example when the switch-on time period of press switch 11 is short, for example, substantially shorter than 0.3 second, the sliding door controller 10 determines that the request is only the request for the automatic closing operation. On the other hand, when the switch-on time period of the press switch 11 is long, for example substantially longer than or equal to 0.3 second, the sliding door controller 10 determines that the lock of the locking mechanism 4 is requested in addition to the automatic closing operation.

The automatic closing operation without the lock of locking mechanism 4 in the state where sliding door 2 is fully open is now explained in more detail. When the user performs the automatic closing operation from the sliding door-fully-opened state, the user performs the press on operation of the outside handle 5 for the short time period. By this operation, in the flow chart in FIG. 7 the routine proceeds according to steps S1→S2→S3→S4→S5→S22, and the automatic closing operation is initiated. The engagement of clutch 6*b* of opening and closing driving mechanism 6 is then made, and the sliding door motor 6*a* is driven and rotates in the direction closing the sliding door 2. The sliding door 2 is therefore slid in the direction of the fully closed position.

After step 22, and on the basis of the processes at steps S23 to S25, when the press-on operation of the outside handle 5 is not performed while the automatic closing operation is in progress, the automatic closing operation is executed until the sliding door 2 reaches the fully closed position.

If the press-on operation of the outside handle 5 is performed while the automatic closing operation is in progress, the routine proceeds according to steps S23→S1→S2→S3→S14. The operation is then switched over to the automatic opening operation, the sliding door 2 is slid until the sliding door 2 fully opens. The determinations at steps S23 and S1 are made at or near the same time (i.e., substantially simultaneously). Thus, the automatic sliding door controller 10 determines that the answer is "YES" at both steps S23 and S1 in one operation of the pressing on of press switch 11.

As explained above, when the user performs the press-on operation of outside handle 5 for the short time period where the sliding door 2 is fully open, the automatic closing operation is executed.

Next, a case where the locking operation of the locking mechanism 4 is made in addition to the automatic closing operation from the sliding door-fully-opened state is explained.

In this case, the user performs the press-on operation of the outside handle 5, and also performs the press-on operation for a longer time period than the specified time period (for example, the switched-ON period of press switch 11 is longer than or equal to 0.3 seconds). In this operation, the routine proceeds according to steps S1→S2→S3→S4→S5→S6 as shown in the flow charts in FIGS. 7 and 8. According to the process at step S6, the locking operation is requested from the intelligent key controller 20 (that is, the lock-request signal is outputted to the intelligent key controller 20). Additionally, the counting of the lock-wait-timer is started.

The intelligent key controller 20 receives the locking-operation-request, and outputs radio waves containing the transmission request signal from the antenna 20*a*. Then, if a portable instrument 21 exists in the communication area, the portable instrument 21 returns radio waves containing the ID signal.

The intelligent key controller 20 checks the received ID signal against the previously stored ID signal. If the received and stored ID signals match, the intelligent key controller 20 outputs an output signal that operates and rotates the door lock motor 4*b* in a direction that locks the sliding door 2. The locking mechanism 4 therefore goes into the locking state in which the locking mechanism 4 does not accept a manual operation of the outside and inside handles 5, 7.

Further, if the locking mechanism 4 goes into the locking state while the lock-wait-timer counts, the routine proceeds according to steps S7→S9. The sliding door controller 10 initiates the automatic closing operation. The count of the lock-wait-timer is the time required for a certain lock of locking mechanism 4 after the lock-request signal is output to intelligent key controller 20. For example, the time can be about 1 second.

At the time of the automatic closing operation, the engagement of the clutch 6*b* of the opening and closing driving mechanism 6 is made, and the sliding door motor 6*a* is driven and rotates in the direction closing the sliding door 2. The sliding door 2 therefore automatically slides in the closing direction. According to the process at step S10, the warning that the sliding door 2 is locked when the sliding door 2 is in the fully closed position is issued by voices and/or beep tones through speaker 9.

The warning and the automatic closing operation are executed until the sliding door 2 reaches the fully closed position unless the press-on operation of the outside handle 5 is made during the automatic closing operation (that is, unless the press switch 11 is depressed).

When the press-on operation of the outside handle 5 is made during the automatic closing operation, the routine proceeds according to steps S11→S1→S2→S3→S14. The operation is then switched over to the automatic opening operation, and the sliding door 2 is slid until the sliding door 2 reaches the fully open position. The determination of switching over to the automatic opening operation at steps S11 and S1 are made at or near the same time (i.e., substantially simultaneously). Thus the automatic sliding door controller 10 determines that the answer is "YES" at both steps S11 and S1 during one operation of the pressing on of press switch 11.

On the other hand, if the locking mechanism 4 is not in the locking state at step S7 despite the fact that a predetermined time to execute the locking operation for locking mechanism 4 elapses (for example, one second) after the lock-request signal is output to the intelligent key controller 20, the count of the lock-wait-timer is completed. The routine then proceeds according to steps S7→S8→S1. The automatic sliding door controller 10 determines that the operation is not the operation performed by the user carrying a portable instrument 21 capable of the locking operation, and consequently does not execute the automatic closing operation.

As described above, when the user performs the press-on operation of outside handle 5 for a relatively long time in the state where the sliding door 2 is fully open, the automatic closing operation is executed, and further the lock of the locking mechanism 4 is made.

When the user performs the press-on operation of outside handle 5 while the automatic opening operation is in progress, the automatic closing operation is executed. That is, the routine proceeds according to steps S1→S2→S5. According to the switch-on time period of the press switch 11 (that is, the length of pressing-on time of the outside handle 5 is the short or longer time), the automatic closing operation is performed or the automatic closing operation plus the locking operation are performed Thus, when the user wants to execute the automatic closing operation when the sliding door 2 is halfway open by manual operation, the user performs the press-on operation of the outside handle 5. The automatic opening operation is initiated. Then, the user performs the press-on operation of the outside handle 5 again, thereby switching over to the automatic closing operation.

When the main switch 12, which switches between the manual opening and closing and the automatic opening and closing of the sliding door 2, is set to the automatic opening and closing, and when the operation of outside handle 5 is made, the opening and closing control apparatus of the first example is configured to determine whether the user requests the manual opening and closing operation or the automatic opening and closing operation depending on whether the operation of outside handle 5 is the pull operation or the press operation. The automatic operation is then executed only at the time of a request for automatic operation.

Accordingly, the user can obtain the convenience of either the automatic opening and closing operation or the manual operation because the user is able to open sliding door 2 to an arbitrary position or is able to quickly open and close sliding door 2, selectively at will, without having to change the main switch 12 provided at the driver's seat.

Namely, a user pull on the outside handle 5 corresponds to a user's intention to manually operate the outside handle 5. The direction of the pulling of the outside handle 5 matches a direction that mechanically releases the lock of sliding door 2 as well. On the other hand, when the user presses on the outside handle 5, its direction is opposite to a direction of an operation generally performed by the user in order to open the sliding door 2. In the example, the opening and closing control apparatus interprets these respective actions as the user's intention to manually operate the outside handle 5 and the request for automatic operation. These actions match the user's natural actions.

In addition, during the automatic operation the opening and closing control apparatus is configured to determine whether the request is an automatic opening operation or an automatic closing operation according to the state of sliding door 2. As a result, a switch of the user's intention can occur with only one press switch 11. The press switch 11 is provided inside the sliding door 2 and has a high degree of flexibility in design. The switch is easily set close to outside handle 5. Further, the design is convenient since there is no need to perform the handle operation and switch operation at once when the user operates the outside handle 5.

Furthermore, when the sliding door 2 is halfway open by a manual operation, and a press-on operation of the outside handle 5 is made, which is a request for the automatic operation, the automatic sliding door controller 10 determines that the request is for the automatic opening operation. Sliding door 2 slides open. Since during the automatic operation from the door half-opened position the operation opening the sliding door is executed first, things or objects are less apt to get caught in the sliding door 2 as opposed to if the operation of closing the sliding door were executed first.

In the first example, where the press-on operation of the outside handle 5 is done during the progress of the automatic opening operation, the automatic sliding door controller 10 determines that the operation is a request for the automatic closing operation. Therefore, when the user wants to execute the automatic closing operation in the case where the sliding door 2 is halfway open by manual operation, the user performs the press-on operation of the outside handle 5, and the automatic opening operation is initiated. Then the user performs the press-on operation of outside handle 5 again to execute the automatic closing operation. In this way, even though the switch synchronizing with the operation of the outside handle 5 is only the press switch 11, it is possible to execute either the automatic opening operation or the automatic closing operation from the door half-opened state. The user can therefore obtain a great convenience.

Figure 9A:
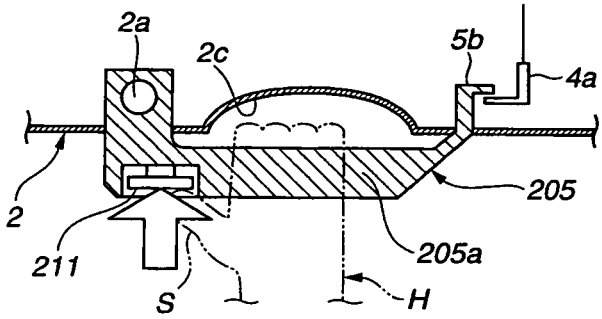
Figure 9B:
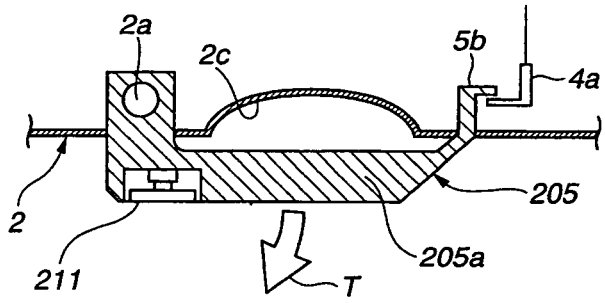

A second example of the opening and closing control apparatus is shown in FIGS. 9A and 9B. The same or equivalent components as that in the first example are denoted by the same reference letters, and their explanations are omitted. Different components from the first example are explained hereinafter.

As shown in FIGS. 9A and 9B, the opening and closing control apparatus has a press switch 211 performing a function as an operation outputting unit. The press switch 211 is placed at a base end portion of an outside handle 205. The press switch 211 is proximate to a rotation axis 2*a* in order for the user to be able to easily perform a press-on operation with a thumb S of an user's hand H when the user grasps a grip portion 205*a* of outside handle 205 by the hand H.

The outside handle 205 is set to a non-operation position as shown FIGS. 9A and 9B by a biasing force of the biasing means (not shown) when there is no application of the operating physical force. As shown in FIG. 9B, the outside handle 205 is supported pivotally in only a pull-direction indicated by an arrow "T" from the non-operation position at the sliding door 2.

In the opening and closing control apparatus, when the user opens or closes the sliding door 2 manually, the user pulls the outside handle 205. In the same manner as the first example, the operating signal is not input to the automatic sliding door controller 10, and the automatic operation is not executed. Therefore, the user can obtain the convenience of the manual operation, such as opening the sliding door 2 halfway and quickly opening or closing the sliding door 2.

On the other hand, when the user executes the automatic operation the user performs the press-on operation of the press switch 211 as shown in FIG. 9A. In this case, the automatic sliding door controller 10 executes the automatic opening operation or the automatic closing operation on the basis of the operating signal from press switch 211 and the state of sliding door 2 detected by the door position detection section 15. The determination of the automatic opening or closing operation is the same as in the first example, and its explanation is omitted here.

Thus, in the opening and closing control apparatus of the second example the following results, same as those of the first example, can be obtained. First, the user can obtain the convenience of selecting the use of the automatic opening and closing operation or the use of the manual at will. Second, the single press switch 211 can be used for determining the user's intention. The switch is easy to set and has a high degree of design flexibility. Third, during the automatic operation from the door half-opened position, the operation in the direction opening sliding door 2 is executed first, so that things or objects are less apt to get caught in the sliding door 2. Lastly, it is possible to execute either the automatic opening operation or the automatic closing operation from the door half-opened state conveniently with only the outside handle 205 acting on the press switch 211. Hence, great convenience can be obtained.

The press switch 211 is placed at an end portion of the outside handle 205, which is proximate to an axis or center of rotation. It is therefore possible to easily perform the press-on operation of the press switch 211 while the user is grasping the grip portion 205*a*.

Next, the opening and closing control apparatus according to a third example is explained with reference to FIG. 10. The same and equivalent components of the first example are denoted by the same reference letters, and their explanations are omitted. The different components are explained hereinafter.

Figure 10:
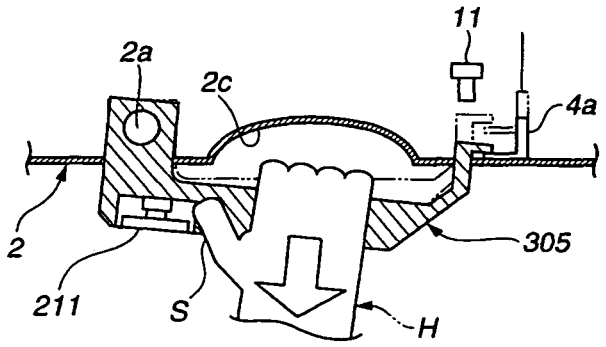
FIG. 10 is a sectional view showing an outside handle of the opening and closing control apparatus according to a third example.

As shown in the sectional view of FIG. 10, the opening and closing control apparatus is provided with a press switch 11 and a press switch 211 at the outside handle 305, where press switch 11 and press switch 211 each perform the function of an operation outputting unit.

The outside handle 305 is supported pivotally in both the inward and outward directions of the vehicle from the neutral position in the same manner as outside handle 5 of the first example.

The press switch 11, which is switched on when pressing the outside handle 305 in the inward direction of the vehicle from the neutral position, is provided inside the sliding door 2. Moreover, press switch 211 is provided at an end portion of outside handle 305 on an outer surface of the outside handle 305, proximate to rotation axis 2*a*.

Accordingly, in the opening and closing control apparatus of the third example, the user can open and close the sliding door 2 manually by the pull operation of the outside handle 305.

On the other hand, when the push-on operation of the press switch 211 is performed or the press switch 11 is switched on by the press-on operation of the outside handle 305, the automatic operation can be executed. Here, the same automatic operation can be executed according to either operating signal of press switch 11 or press switch 211. Or, the automatic opening operation can be executed according to either one of the press-on operation of the press switch 11 or the push-on operation of the press switch 211, and then the automatic closing operation can be executed according to another operation of the press switch 11 or the press switch 211.

Accordingly, in the opening and closing control apparatus of the third example, too, the user has the convenience of selecting at any time the automatic opening and closing operation or the manual operation.

The opening and closing control apparatus according to the third example provides both the press switch 11 and the press switch 211. The user can operate the two switches 11, 211 independently when requesting the automatic opening and/or closing operation. And by dividing these switches according to the request, the determination of whether the request is for the automatic opening operation or for the automatic closing operation is simplified.

The structure and configuration, operations and also effects of the components of the third example are the same as the first example, and therefore their explanations are omitted here.

Although all three examples have been described in detail with reference to the drawings, possible structures or configurations are not limited to these examples.

For example, although the three examples pertain to a side sliding door, the opening and closing control apparatus can be applied to other doors, such as a back door. Further, although the outside handle 5, 205, 305 provided on the outer side of sliding door 2 are described as the door lever, the door lever can also be the inside handle 7 provided on the inner side of sliding door 2.

Furthermore, in the examples, the pull operation of the outside handle 5, 205, 305 is described as the manual opening and closing operation of the door lever. The press-on operation of the outside handle 5 and the push-on operation of the press switch 211 are also described as the predetermined operation different from the manual opening and closing operation of the door lever. However, the manual opening and closing operation is not limited to this. For example, the user may pull the handle in the rear direction of the vehicle when opening the door, and may pull the handle in the front direction of the vehicle when closing the door. In that case, as shown in FIGS. 11A and 11B, the user can perform the press-on operation of the press switch as the predetermined operation.

Figure 11A:
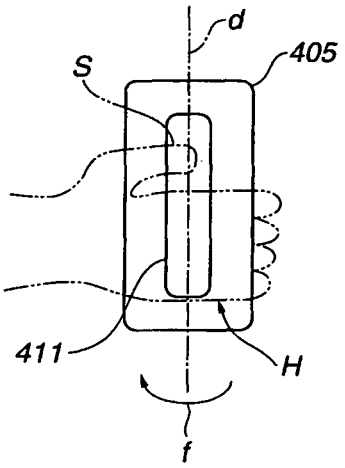
Figure 11B:
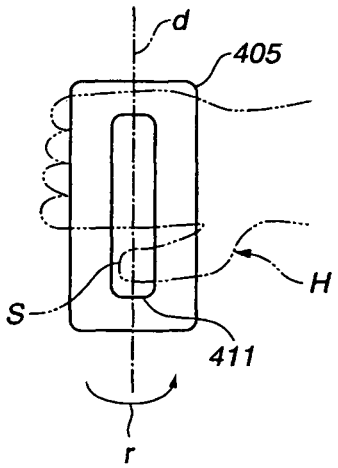

As seen in FIGS. 11A and B, when the user pulls an outside handle 405 so that outside handle 405 rotates in a direction indicated by an arrow "f" about an axis "d" (FIG. 11A), and also when the user pulls the outside handle 405 so that outside handle 405 rotates in a direction indicated by an arrow "r" about the axis "d" (FIG. 11B), a latch of the locking mechanism (not shown in FIGS. 11A and B) is released. A press switch 411 that performs the function of an operation outputting unit is provided at a middle portion of the outside handle 405. The shape of the press switch 411 is long in upper and lower (i.e., vertical) directions so that the user can perform the press-on operation of the press switch 411 with the thumb S in either case of operation of outside handle 405 by the hand H as shown in FIGS. 11A and 11B. However, two press switches could be independently provided at upper and lower portions.

In the example shown in FIGS. 11A and B, when the user operates the outside handle 405 the automatic sliding door controller 10 determines that the user requests the manual operation, and consequently does not execute the automatic operation. When the press-on operation of the press switch 411 is performed, the automatic operation is executed. The control of this case is the same as that of the first example. When press switches are provided as explained in the third example, the automatic sliding door controller 10 can determine that the user's request is the automatic opening operation according to either one of the press-on operation of the two press switches. Then the automatic sliding door controller 10 can determine that the user's request is the automatic closing operation according to the other press-on operation.

In the above examples, the press switches 11, 211, 411 are described as an operation outputting unit. However, the operation outputting unit is not limited to these switches. For example, a switch (or switches) that outputs two kinds of signals for the automatic opening and closing operations may be provided.

Further, in the first example, when the locking operation is made along with the automatic closing operation, the warning is issued after the automatic closing operation is initiated (steps S9→S10). However, the warning is not limited to this. For example, the warning can be first issued when the press switch 11 changes from "OFF" to "ON" by another press-on operation of press switch 11. Then the automatic closing operation could be initiated.

Also, the above-described examples have been described in order to allow easy understanding of the present invention and do not limit the present invention. On the contrary, the disclosure is intended to cover various modifications and equivalent arrangements which scope is to be accorded the broadest interpretation so as to encompass all such modifications and equivalent structure as is permitted under the law.

What is claimed is:

1. An opening and closing control apparatus for a door, comprising:

a driving unit operable to electronically move the door between an open position and a closed position in response to an operating request;

a door lever positioned on the door, said door lever movable in a first direction from a neutral position of the door lever to a first position wherein the door lever contacts an operation output unit, and said door lever movable in a second direction from the neutral position of the door lever to a second position wherein the door lever releases the door from a latch to allow manual movement of the door between the open position and the closed position without activating the driving unit;

the operation output unit positioned proximate the door lever and outputs an operating signal when the door lever is moved to the first position and contacts the operation output unit; and a controller outputs the operating request for one of an electronic door movement operation to the open position and an electronic door movement operation to the closed position based on the operating signal.

2. The apparatus according to claim 1 wherein the operation output unit is a switch.

3. The apparatus according to claim 1, further comprising:

a locking mechanism for the door switchable between a lock state and an unlock state; and the controller configured to send an unlock request signal to move the locking mechanism from the lock state to the unlock state when the operating request is for the electronic door movement operation to the open position and the locking mechanism is in the lock state.

4. The apparatus according to claim 3 wherein the controller is configured to determine whether a previously registered portable instrument exists in a communication area and to prohibit movement of the locking mechanism from the lock state to the unlock state when the previously registered portable instrument is not in said communication area.

5. The apparatus according to claim 1, further comprising:

a locking mechanism for the door, the locking mechanism switchable between a lock state and an unlock state; and the controller configured to determine whether the electronic door movement operation to the closed position includes moving the locking mechanism to the lock state;

wherein when both the door is in said closed position and the controller determines that the electronic door movement operation to the closed position includes moving the locking mechanism to the lock state, the controller switches the locking mechanism to the locked state.

6. The apparatus according to claim 5 wherein the controller is configured to determine if a previously registered portable instrument exists in a communication area and to prohibit movement of the locking mechanism to the lock state when the portable instrument is not in said communication area.

7. The apparatus according to claim 5, further comprising:

a speaker responsive to the controller for announcing movement of the door to the closed position and when the locking mechanism is in the lock state.

8. The apparatus according to claim 1, wherein the controller is configured to determine that the operating signal is for the electronic door movement operation to the open position when the door is in said closed position.

9. The apparatus according to claim 1, wherein the controller is configured to determine that the operating signal is for the electronic door movement operation to the closed position when the door is in said open position.

10. The apparatus according to claim 1, wherein the controller is configured to determine that the operating signal is for the electronic door movement operation to the open position when the door is between the open position and the closed position.

11. The apparatus according claim 10 wherein the controller is configured to change the operating request from the operating request for the electronic door movement operation to the open position to the operating request for the electronic door movement operation to the closed position when the operating signal is output during the electronic door movement operation to the open position.

12. The apparatus according to claim 1, wherein the controller is configured to:

receive an input pertaining to a position of the door when the operating signal is output; and output the operating request based on the position of the door.

13. The apparatus according to claim 1, wherein the door lever is movable to the first position in response to a first manual user operation of the door lever and movable to the second position in response to a second manual user operation of the door lever which is different from the first manual user operation of the door lever.

14. An opening and closing control apparatus for a door, comprising:

a driving unit operable to electronically move the door between an open position and a closed position in response to an operating request;

a door lever positioned on the door, said door lever movable in a first direction from a neutral position of the door lever to a first position wherein the door lever contacts an operation output unit, and said door lever movable in a second direction from the neutral position of the door lever to a second position wherein the door lever releases the door from a latch to allow manual movement of the door between the open position and the closed position without activating the driving unit;

the operation output unit positioned proximate the door lever and outputs an operating signal when the door lever is moved to the first position and contacts the operation output unit;

a position detection device operable to detect the open position of the door, the closed position of the door and an intermediate position of the door;

a controller configured to:

receive input from the position detection device, and output an electronic operating request for one of an electronic door movement operation to the open position and an electronic door movement operation to the closed position based on the operating signal and the position of the door.

15. The apparatus of claim 14, wherein the controller is configured to determine that the operating signal is for the electronic door movement operation to the open position when the door is detected to be in the closed position.

16. The apparatus of claim 14, wherein the controller is configured to determine that the operating signal is for the electronic door movement operation to the closed position when the door is detected to be in the open position.

17. The apparatus of claim 14, wherein the controller is configured to determine that the operating signal is for the electronic door movement operation to the open position when the door is detected to be in the intermediate position.

18. The apparatus of claim 17 wherein, the controller is configured to change the electronic operating request from the electronic operating request for the electronic door movement operation to the open position to the electronic operating request for the electronic door movement operation to the closed position when the operating signal is output during the electronic door movement operation to the open position.

* * * * *